US006398629B1

(12) United States Patent
Bavelloni

(10) Patent No.: US 6,398,629 B1
(45) Date of Patent: Jun. 4, 2002

(54) BILATERAL EDGE-TYPE MACHINE FOR EDGE-MACHINING GLASS OR STONE-LIKE PLATE MATERIALS AND THE LIKE

(75) Inventor: Franco Bavelloni, San Fermo Della Battaglia (IT)

(73) Assignee: Z. Bavelloni S.p.A., Bregnano (IT)

( * ) Notice: Subject to any disclaimer, the term of this patent is extended or adjusted under 35 U.S.C. 154(b) by 0 days.

(21) Appl. No.: 09/578,510

(22) Filed: May 26, 2000

(30) Foreign Application Priority Data

Jun. 21, 1999 (IT) ..... MI99041 U

(51) Int. Cl.[7] ..... B24B 7/00
(52) U.S. Cl. ..... 451/194; 451/41; 451/44
(58) Field of Search ..... 451/57, 41, 44, 451/43, 63, 65

(56) References Cited

U.S. PATENT DOCUMENTS 1,071,049 A * 8/1913 Hill ..... 451/451
3,187,467 A * 6/1965 Cortesi ..... 451/44
3,805,455 A 4/1974 Aellig et al.
3,813,826 A * 6/1974 Bando ..... 451/342
3,827,189 A 8/1974 Highberg et al.
4,375,141 A * 3/1983 Gaetano ..... 451/65
4,375,738 A * 3/1983 Bando ..... 451/65
5,117,590 A * 6/1992 Kudo et al. ..... 451/44
5,810,642 A * 9/1998 Bando ..... 451/44
6,053,804 A * 4/2000 Parulski ..... 451/415

FOREIGN PATENT DOCUMENTS

EP 0 451 333 10/1991
GB 2 261 433 5/1993

* cited by examiner

*Primary Examiner*—M. Rachuba
(74) *Attorney, Agent, or Firm*—Guido Modiano; Albert Josif; Daniel O'Byrne

(57) ABSTRACT

A bilateral edge-type machine for machining the edges of glass, or stone-like plate materials and the like comprising a supporting frame for a plurality of machining heads arranged on both sides of the plate being machined. Each head comprises a structure associated with a supporting body which is connected to the frame. The structure has, on one side, a grinding wheel supporting spindle which is directed upward and, on the other side, an actuation motor which is directed upward. The motor is connected to the spindle by way of a belt drive.

6 Claims, 2 Drawing Sheets

BILATERAL EDGE-TYPE MACHINE FOR EDGE-MACHINING GLASS OR STONE-LIKE PLATE MATERIALS AND THE LIKE

BACKGROUND OF THE INVENTION

The present invention relates to a bilateral edge-type machine for machining the edges of plates of glass, stone-like and other plate shaped materials and the like.

It is known that bilateral edge-type machines for machining the edges of plates of glass, stone-like materials and the like are generally constituted by a supporting frame for a conveyor for conveying the plates for machining under a plurality of machining heads, arranged on either side of the plate.

The machining heads are generally constituted by a grinding wheel supporting spindle, on the axis of which a motor is provided.

The motor-spindle assembly must be pivoted to the supporting structure so that it can be turned over when it is necessary to change the grinding wheel when it is worn.

In order to put a remedy to the drawback of having to overturn the assembly in order to replace the grinding wheel, machining heads have already been introduced in which the grinding wheel supporting spindles are directed upward, allowing easy replacement of the grinding wheels. In this case, the actuation motors are not axially aligned with the spindle but are spaced and arranged so that they lie on the opposite side with respect to the spindle, i.e., toward the bottom of the structure.

The connection to the spindle is provided by means of belts.

The fact of having motors which are directed downward causes severe problems in applying and adjusting the grinding wheels when it is necessary to produce the advancement of the grinding wheels due to wear, said advancement being produced by hinge coupling.

SUMMARY OF THE INVENTION

The aim of the invention is to solve the above problems, by providing a bilateral edge-type machine for machining the edges of plates of glass, stone-like materials and the like which allows to have the spindle directed upward and therefore have an easily accessible grinding wheel, without however having the typical problems of motors arranged so as to be directed downward.

Within the scope of this aim, a particular object of the invention is to provide a bilateral edge-type machine which allows to perform all adjustments very easily and quickly, eliminating machining imperfections such as the typical undulations on the surface of the glass edge.

A further object of the present invention is to provide a bilateral edge-type machine whose spindle can be disassembled easily, thus allowing simple and low-cost maintenance.

Still a further object of the present invention is to provide a bilateral edge-type machine for machining the edges of plates of glass, stone-like materials and the like which can be easily obtained starting from commonly commercially available elements and materials and is furthermore competitive from a merely economical point of view.

These and other objects which will become better apparent hereinafter are achieved by a bilateral edge-type machine for machining the edges of glass or stone-like plate materials and the like, according to the invention, comprising a supporting frame for a plurality of machining heads on both sides of the plate being machined, characterized in that each head comprises a structure associated with a supporting body which is connected to said frame, said structure having, on one side, a grinding wheel supporting spindle which is directed upward and, on the other side, an actuation motor which is directed upward, said motor being connected to said spindle through a belt drive.

BRIEF DESCRIPTION OF THE DRAWINGS

Further characteristics and advantages will become better apparent from the following detailed description of a bilateral edge-type machine for machining the edges of plates of glass, stone-like materials and the like, illustrated only by way of non-limitative example in the accompanying drawings, wherein.

DESCRIPTION OF THE PREFERRED EMBODIMENTS

Figure 1:
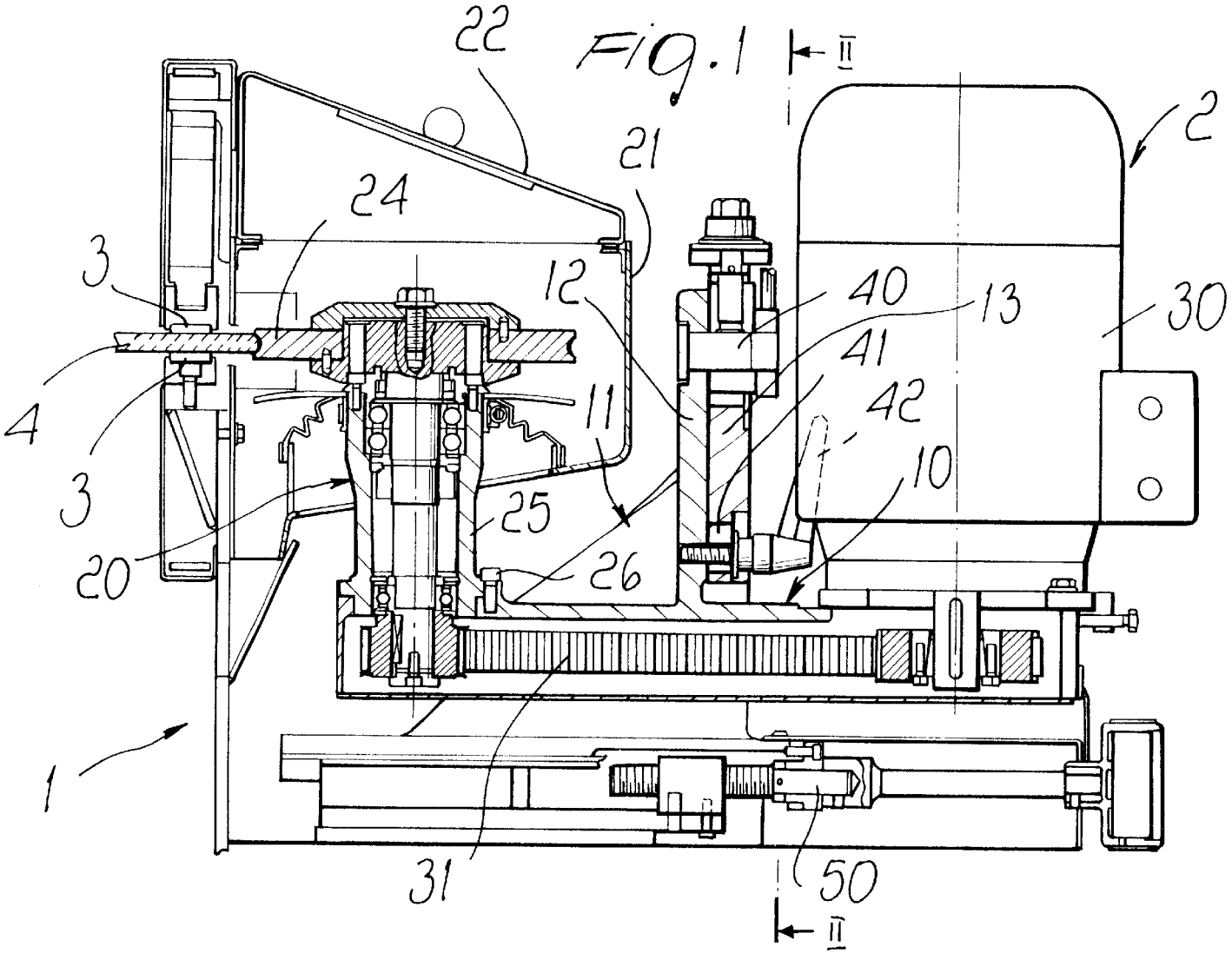
FIG. 1 is a schematic sectional view of a machining head.
Figure 2:
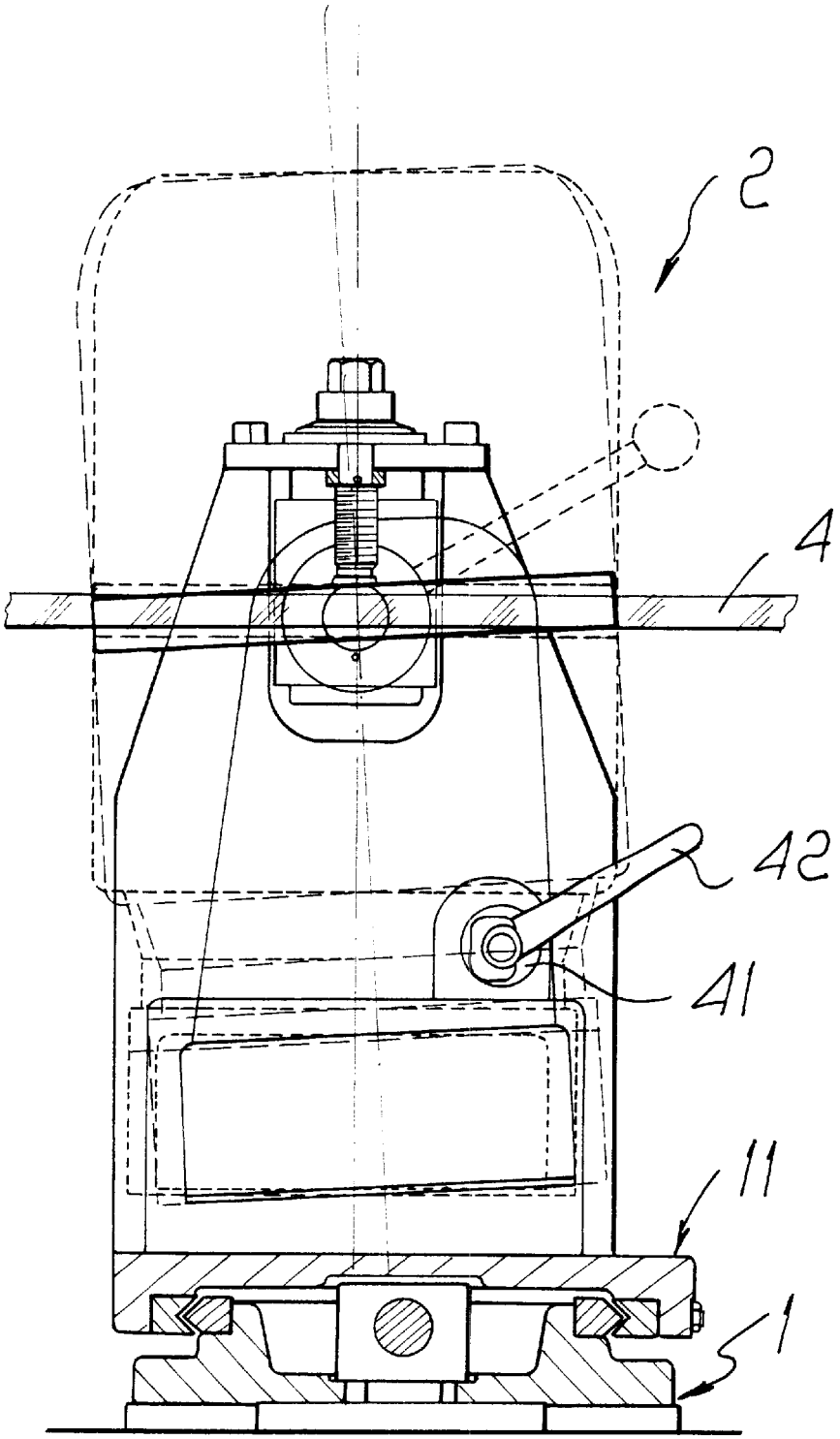
FIG. 2 is a sectional view of the machining head, taken along the line II—II of FIG. 1, illustrating the possible oscillations of the assembly.

With reference to the above figures, the bilateral edge-type machine for machining the edges of plates of glass, stone-like materials and the like comprises a frame 1 with which a plurality of machining heads, designated by the reference numeral 2, are associated.

In a per se known manner, the frame 1 forms a conveyor 3 which is constituted by belts engaging the plate 4 being machined in order to convey it through the machining heads, which are distributed on opposite sides.

The main feature of the invention consists in that each machining head comprises a structure 10 which is connected to a supporting body 11, advantageously constituted by a slider element, which slidingly engages the frame 1 and forms a plate 13 for connection to a complementary plate 12 of the structure 10, as described in greater detail hereinafter.

The structure 10 has, on one side, a grinding wheel supporting spindle 20 which is accommodated in a housing 21 formed by the frame 1 and provided with an upper openable door 22 for accessing the grinding wheel 24 of the spindle 20.

The body 25 of the spindle 20 can be easily detached for replacement and maintenance simply by acting on the bolts 26 for fixing to the structure 10.

The driving motor 30 is connected on the other side of the structure 10 with respect to the plate 13, protrudes upward and is operatively associated with the spindle 20 through a belt drive, designated by the reference numeral 31.

In order to adjust the inclination of the grinding wheel with respect to the vertical axis, the structure 10 is hinged by means of the pivot 40 to the plate 13 of the supporting body 11, and there is an eccentric element 41 with a locking lever 42 or another similar solution which allows to set the chosen inclination and perform locking.

In order to compensate for grinding wheel wear, the slider-shaped supporting body 11 can be made to perform a translatory motion by virtue of a translatory motion assembly 50 which can be accessed from outside so as to move the grinding wheel against the glass being machined, keeping grinding wheel wear compensated at all times.

From the above description it is thus evident that the invention achieves the intended aim and objects, and in particular the fact is stressed that the adopted solution, with the motor directed upward, allows optimum accessibility of the machine as well as a very rigid structure of the assembly, since the hinge coupling of the supporting structure of the machining head is provided very close to the grinding wheel supporting spindle, thus avoiding undulations on the surface of the edge of the glass.

Moreover, the spindle can be easily disassembled for simple and low-cost maintenance, and the possibility of the machining head to perform a horizontal translatory motion toward the plate always allows to easily compensate for grinding wheel wear.

In practice, the materials employed, so long as they are compatible with the specific use, as well as the contingent shapes and dimensions, may be any according to requirements.

The disclosures in Italian Utility Model Application No. M199U000410 from which this application claims priority are incorporated herein by reference.

What is claimed is:

1. A bilateral edge-type machine for machining edges of plates of glass, stone-like and other plate shaped materials, having a supporting frame and a plurality of machining heads on both sides of a plate to be machined, and wherein each head comprises: a supporting body which is connected to said frame; a structure, associated with said supporting body; a grinding wheel supporting spindle which is directed upward and is arranged at a first side of said structure; a grinding wheel rotatably positioned on said grinding wheel supporting spindle for machining and edge of a plate arranged in a horizontal plane; and an actuation motor which is directed upward and is arranged at a second, opposite side of said structure with respect to said first side of said structure at which said grinding wheel supporting spindle and said grinding wheel are arranged; and a belt drive which operatively connects said motor to said spindle.

2. The bilateral edge-type machine of claim 1, wherein said supporting body is constituted by a slider element, slidingly engaging said frame for performing a translatory motion in a direction which is substantially perpendicular to an edge of the plate to be machined.

3. The bilateral edge-type machine of claim 2, further comprising a housing for accommodating said grinding wheel supporting spindle, said housing being provided with an openable door in its upper region.

4. A bilateral edge-type machine for machining edges of plates of glass, stone-like and other plate shaped materials, having a supporting frame and a plurality of machining heads on both sides of a plate to be machined, and each head comprising: a supporting body which is connected to said frame; a structure, associated with said supporting body; a grinding wheel supporting spindle which is directed upward and is arranged at a first side of said structure; and an actuation motor which is directed upward and is arranged at a second, opposite side of said structure; and a belt drive which operatively connects said motor to said spindle, and further comprising a housing for accommodating said grinding wheel supporting spindle, said housing being provided with an openable door in its upper region, and further comprising bolts for fixing said spindle to said structure, said bolts being accessible by opening said door.

5. A bilateral edge-type machine for machining edges of plates of glass, stone-like and other plate shaped materials, having a supporting frame and a plurality of machining heads on both sides of a plate to be machined, and each head comprising: a supporting body which is connected to said frame; a structure, associated with said supporting body; a grinding wheel supporting spindle which is directed upward and is arranged at a first side of said structure; and an actuation motor which is directed upward and is arranged at a second, opposite side of said structure; and a belt drive which operatively connects said motor to said spindle; and further comprising a plate formed by said supporting body, a complementary plate which is formed by said structure and a pivot which connects said plate and complementary plate to each other so as to allow oscillation about an axis being substantially horizontal and perpendicular to the edge of the plate being machined.

6. The bilateral edge-type machine of claim 5, wherein said pivot is arranged proximate to the grinding wheel supported by said spindle.

* * * * *